United States Patent [19]

Harless et al.

[11] 4,216,931

[45] Aug. 12, 1980

[54] DRYING RACK FOR FIRE HOSE

[76] Inventors: Clarence E. Harless; Jessie C. Tiger, both of 2101 H St., Bakersfield, Calif. 93301

[21] Appl. No.: 7,336

[22] Filed: Jan. 29, 1979

[51] Int. Cl.[2] ..... A47G 29/00

[52] U.S. Cl. ..... 248/89; 248/90

[58] Field of Search ..... 248/89, 90, 75, 125, 248/123, 295 R, 295 A; 211/59.1; 182/142; 187/95, 6, 2

[56] References Cited

U.S. PATENT DOCUMENTS

| | | | |
|---|---|---|---|
| 533,826 | 2/1895 | Now | 248/89 |
| 544,951 | 8/1895 | Bramble | 248/89 |
| 965,432 | 7/1910 | Bennett | 248/90 |
| 1,306,297 | 6/1919 | Aueroch | 211/59.1 X |
| 2,122,908 | 7/1938 | Collins | 187/6 |
| 2,951,589 | 9/1960 | Dudley | 211/59.1 |
| 3,385,401 | 5/1968 | Campbell et al. | 187/95 X |

FOREIGN PATENT DOCUMENTS

| | | | |
|---|---|---|---|
| 653244 | 12/1962 | Canada | 248/89 |
| 838248 | 7/1949 | Fed. Rep. of Germany | 248/89 |

*Primary Examiner*—James T. McCall

*Attorney, Agent, or Firm*—Julius L. Rubinstein

[57] ABSTRACT

A rack comprising a plurality of generally horizontally projecting hose supporting pegs is moveably mounted on a vertical support. A power train is connected to the rack to raise and lower it on the support. The midpoint of a fire hose which is to be dried, is draped over a horizontal peg and when the rack is elevated, the half portions of the fire hose hang vertically downward for drying. In this way, the rack can mass-dry a number of fire hoses simultaneously in accordance with the number of pegs on the rack.

7 Claims, 5 Drawing Figures

DRYING RACK FOR FIRE HOSE

BACKGROUND AND BRIEF SUMMARY

When fire hoses are used to fight a fire, they must be washed and dried before they are rolled up for storage. A number of devices have heretofore been used for drying hoses. One approach, as exemplified by the patent to Ferguson, U.S. Pat. No. 1,897,248, involved installing a support on the top roof of a fire house. Then a pulley was mounted on the support. A cable passed over the pulley with the ends reaching the ground. One end of the cable was attached to one end of a fire hose. Then a person on the ground pulled the other end of the cable. In this way, the fire hose could be pulled upward until the upper end was high enough so a person on the roof could lift the upper end of the hose off the pulley and suspend it on the arms of the support, leaving the remaining portion of the fire hose to hang vertically. Then the person on the roof moved the pulley so that another hose could be pulled upwards to rest on other arms of the support at the top of the fire house.

This structure was objectionable because it required two men to hang each fire hose, one on the ground to hoist the fire hose to the roof of the fire house, and the other on the roof to remove the hose from the hoist and install it on the arms of the support. This was a somewhat dangerous procedure because it required a person, usually a fireman, on the roof, to extend a part of his body over the edge of the roof in order to disconnect the end of the fire hose from the pulley and to suspend the fire hose on to the arms of the support. This danger was substantially magnified in climates where the roof of the fire house was covered with snow and ice, making it slippery. Furthermore, the hoses had to be separately raised and hung, and afterwards, separately removed. This was time consuming. In addition, because the length of each fire hose is fifty feet, the roof of the fire house had to be at least fifty feet high, which added to the danger to the person on the roof. In situations where the roof of a fire house was too low, expensive scaffolding was required to provide the required height, and this was expensive.

Another approach, as exemplified by the patent to Fishbourne, utilized a dual rack arrangement. The racks comprised a plurality of slats and one rack could be elevated with respect to the other. In operation, one portion of a fire hose was laid on the upper rack and then the rack was raised and the remaining portion of the fire hose was folded down over the upper rack and laid on the lower rack. In this way, a number of fire hoses could be dried simultaneously by laying the hoses parallel to each other on the slats of the rack.

This arrangement was objectionable because the drying racks utilized a great deal of ground or floor space because the hoses, for the most part, were laid out generally horizontally. However, space is expensive and not always available. Furthermore, the hoses to be dried had to be carefully laid on the upper rack in spaced parallel relationship to each other. This was not easy to do when the hoses were stiff because of exposure to low temperatures. Under such circumstances, the hoses had to be placed in a building where they could be warmed to restore their flexibility. Then the upper rack had to be raised and the remaining part of the fire hose also had to be folded over the upper rack and laid in parallel relationship to each other on the lower rack. This was too time consuming to be practical.

In this invention, the disadvantages of the prior art devices for drying fire hoses are overcome in that the mid-point of the hoses to be dried are draped over pegs on the rack and the rack is then raised, leaving the two half portions of each hose to hang vertically. Since the hoses hang vertically from pegs, the horizontal space required to dry the hoses using the present invention is only a small fraction of the space required by the Fishbourne approach and the present invention requires only one man to dry the hoses. This is in contrast to the Ferguson structure which requires two men to operate.

What is needed, therefore, and comprises an important object of this invention, is to provide a rack for drying hoses which requires a comparatively small amount of floor space and which can be operated by only one man.

This, and other objects of this invention, will become more apparent from the following specification and drawings wherein.

Figure 1:
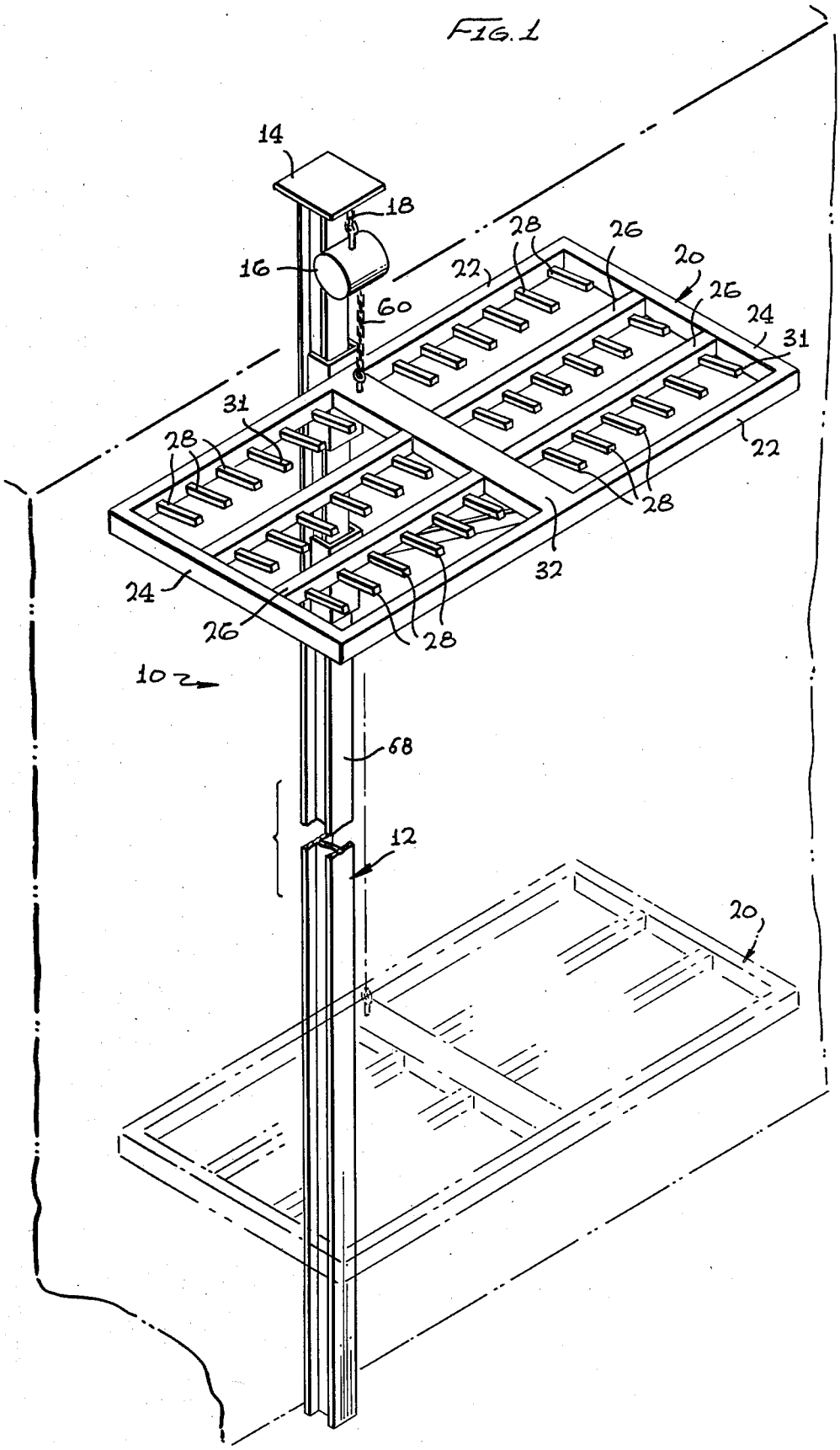
FIG. 1 is a perspective view of the drying rack constructed according to the principles of this invention.

Referring now to FIG. 1 of the drawing, a drying rack for fire hoses indicated generally by the reference numeral 10 comprises a vertical support 12. In this particular embodiment, the vertical support is in the form of an I-beam, although other supports can be used.

A rectangular planar support 14 is mounted on the upper end of the I-beam 12 and a generally conventional electrical power hoist 16 is suspended from the support beam by a chain 18, see FIG. 1. A platform rack 20 is moveably mounted on the vertical support. In this particular embodiment, the rack 20 is generally rectangular in shape. The rack comprises protective side guide bars or rails 22 and protective end guide bars or rails 24 which are connected together by any suitable means. In addition, connecting guide bars 26 parallel to the side bars or rails 22 are connected between the end rails 24 and a centrally disposed support bar 32 to which the chain portion of the hoist 16 is attached.

Figure 3:
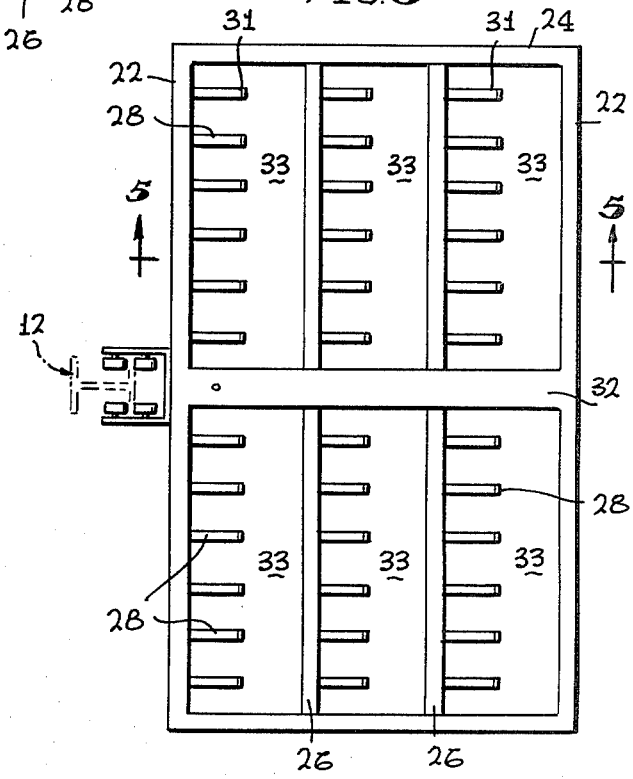
FIG. 3 is a plan view of the rack taken on a line 3—3 of FIG. 2.

A plurality of spaced parallel hose support pegs 28 are connected at one end to side bar 22 and to the connecting bars 26 by any suitable means, as shown in FIGS. 1 and 3. The opposite or free end 31 of each support peg projects in the same direction and the hose support pegs are spaced from each other by a distance greater than the diameter of the fire hoses to be dried.

The hose support pegs are all the same length, and the space between a line connecting the free ends 31 of the hose support pegs and the adjacent connecting bar 26 or protective rail 22 defines an elongated hose receiving guide channel or space 33, comfortably greater in width than the diameter of the fire hoses, but small enough to serve as a guide channel, for reasons to become apparant below. The protective side and end guide rails have two functions. First, they rigidize the rack by supporting both ends of each connecting bar 26. In addition, they protect the hose support pegs which are supported at only one end from damage caused by accidental impacts.

Figure 4:
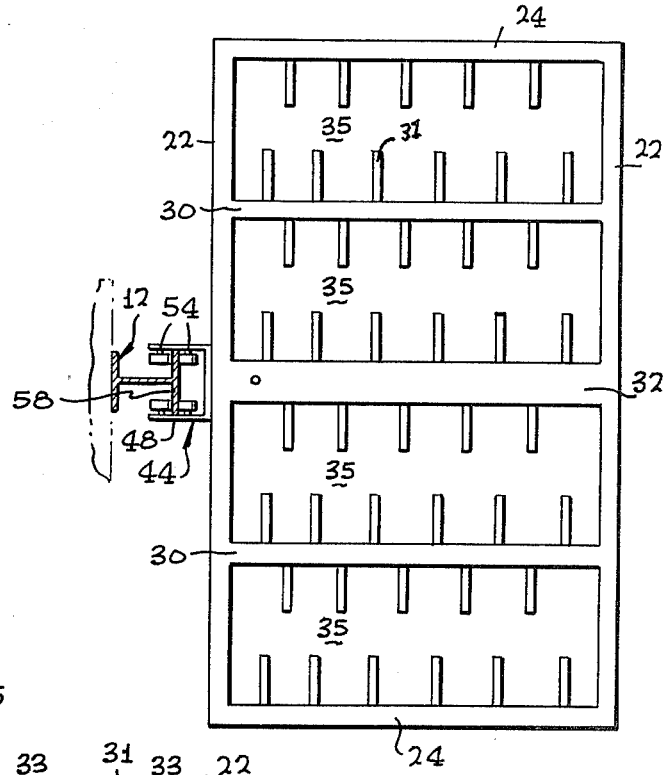
FIG. 4 is a modified version of the structure shown in FIG. 3.

In the modification shown in FIG. 4, the platform 20 has the same protective side and end guide bars or rails 22 and 24. The side rails are connected together by connecting guide bars 30. These connecting bars are parallel to the protective end rails 24 and to the central support bar 32 which connect the side rails 22 to each other and to which, as stated above, the hoist 16 is attached, see FIG. 1. In this embodiment, the free ends 31 of the hose support pegs 28 project in opposite directions, and are laterally spaced from each other by a distance greater than the diameter of the fire hoses to be dried. Since the pegs are all the same length, the space between a line drawn between the ends of the hose support pegs projecting in one direction and a line joining the ends 31 of the hose support pegs projecting in the opposite direction, defines an elongated hose receiving guide channel or space 35, see FIG. 4. This arrangement, because of the large number of pegs, permits a greater number of hoses to be simultaneously dried on the rack than in the embodiment shown in FIG. 3.

Figure 2:
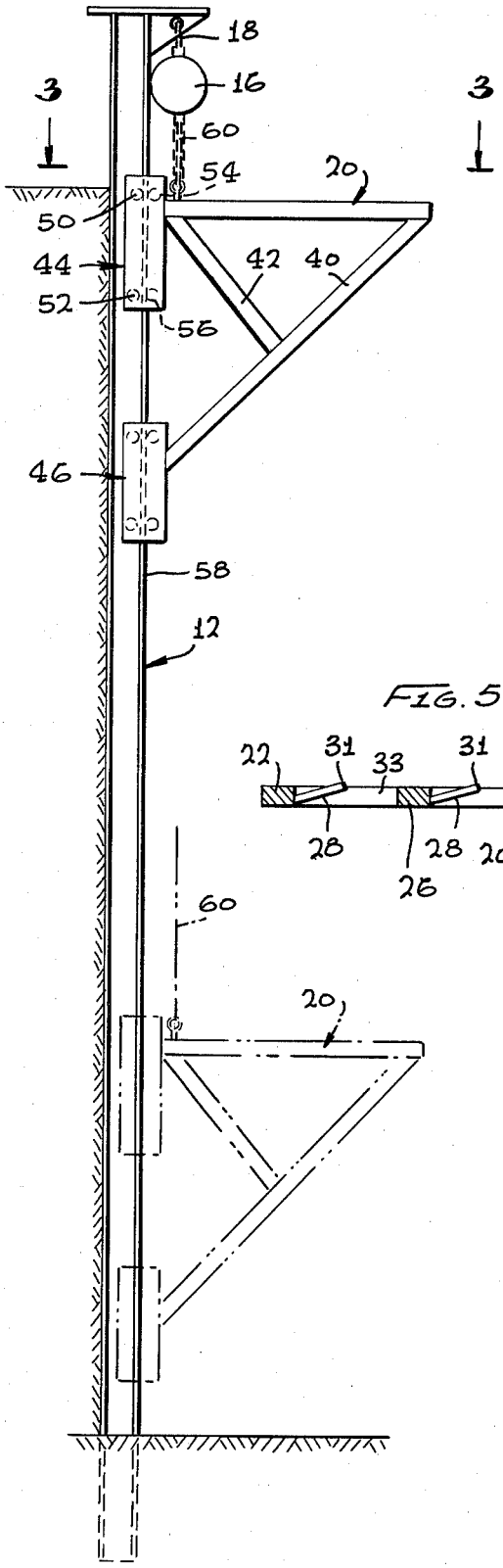
FIG. 2 is an elevational view of the drying rack shown in FIG. 1.

As seen in FIG. 2, rack 20 is supported on a support 12 by means of rack support brace or struts 40 and 42. Upper and lower truck members 44 and 46 are rigidly connected to the side rail 22 and to the end of support strut 40 remote from the support or rack 20.

Each truck member comprises a channel shaped support member 48, the sides of which embrace the outer edges of the I-beam 12 and, in particular, the outer edges of end wall 58 of the support beam 12, see FIGS. 3 and 4. Each channel support member 48 has upper and lower axles 50 and 52 on which rollers 54 and 56 are mounted. These rollers roll against opposite surfaces of the end wall 58 of the I-beam 20, see FIG. 4.

A chain 60, which is part of the power hoist 16, and which rolls around the toothed wheels or pulleys in the power hoist, is connected from the power hoist 16 to support bar 32 on the rack platform 20 as shown in FIG. 2.

The power hoist is operated by any suitable ground positioned electrical control means, not shown. In this way, the rack platform 20 can be raised or lowered from the ground using any conventional suitable electrical control system.

In use, the fire hose is first bent in half and the bent end is inserted in the space 33 or 35 so the hose is in a plane perpendicular to the projecting hose support pegs. Then the hose is moved so the bent portion of the hose is draped over at least one peg leaving the half portions of each hose dangling vertically.

It is apparent that when the fire hoses have been used to put out fires in frigid temperatures, water on the hose and low temperatures can combine to make the hose so stiff so that it can't be bent around a single support peg. With this present structure, it is not necessary to warm the hose before it can be hoisted on the rack for washing or drying. If stiffness makes the bend of the hose greater than the separation between the hose support pegs, the bent end can be inserted in the elongated channel spaces 33 or 35 and the hose can be draped over more than one of the hose support pegs as shown in FIG. 3. After the hoses have been draped over one or more of the hose support pegs, the rack platform may be raised so the hoses can be washed, if required, and then dried. After the hoses are dried, the rack platform is lowered and the hoses are removed for storage.

In the embodiment shown in FIG. 3, the end and side protective guide rails 22 and 24, the support bar 32, and the connecting guide bar 26, serve an important function because the rack is designed so the width of the space 33 between the free ends of the pegs 28 and a connecting guide bar or rail is large enough to permit the bent portion of a fire hose to be easily inserted in space 33, but small enough so the connecting guide bars or protective rails surrounding space 33 hold the bent end of the hose in the space 33 in a plane transverse to the direction of the hose support peg 28. Fire hoses are heavy and even more so when they are weighed down by an accumulation of ice or mud after use. This arrangement permits one man to mount the bent portion of the fire hose on the hose support pegs because he can rely on the support offered by the adjacent connecting guide bars or rails to hold the bent portion of the fire hose in an approximately correct position in space 33 when mounting the hoses on the pegs. Without this structure, more than one man would be required to do this work.

As stated above, when the fire hoses are used in damp or frigid temperatures, the hoses may become so coated with mud or ice that they cannot be bent sufficiently to permit them to be mounted securely around the hose support pegs in the rack. Under these circumstances, there is a chance that the muddy or ice-covered fire hoses could fall off the ends of the hose support pegs. If this happens, the adjacent protective guide rails or bars function so that they engage the falling portion of the fire hoses and prevent the hoses from falling outwardly away from the hose support rack and possibly causing injury to persons near-by but not under the rack. Instead, the engagement between the falling hoses and the guide rails or bars tends to guide the falling hoses so they fall to the ground in the region directly below the platform rack.

Figure 5:
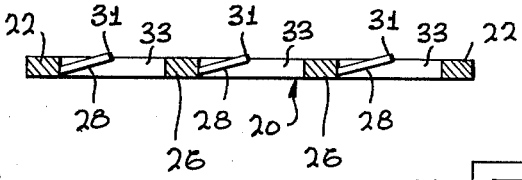
FIG. 5 is view taken on a line 5—5 of FIG. 3 but showing a modified version of the rack.

In the embodiment shown in FIG. 5, the hose support pegs project in a slightly upwardly inclined direction from the plane of the rack. This arrangement helps keep the fire hoses on the pegs and prevents ground vibration caused by passing trucks and the like from vibrating the fire hoses off the pegs and letting them fall to the ground. It is contemplated that the upwardly inclined hose supporting pegs would be useful in situations were the rack comprised only a central support to which the hoist chain is attached with the hose supporting pegs fastened at one end to the central support and with their opposite ends projecting generally radially outward from the support or simply projecting away from the support in a spaced relationship to each other.

Having described the invention, what I claim is new is:

1. An apparatus for drying fire hoses comprising a vertical support, a hoist, at least a portion of the hoist mounted at least near the upper ends of the vertical support, a platform rack moveably mounted on said vertical support, a support bar on the platform rack, means connecting at least a portion of the hoist with the support bar, hoist control means connected to at least a portion of the hoist for raising and lowering the platform rack, said platform rack comprising a surrounding rectangular framework of protective guide rails including parallel side and parallel end guide rails, said support bar connected between parallel protective side rails, connecting bars parallel to said side rails and connected between the end protective rails and to the support bar, hose support pegs surrounded by parallel side and end guide rails mounted in spaced parallel relationship to each other and to the end protective rails and connected at only one end to a side protective rail or a connecting bar and projecting toward but not reaching a protective guide bar or rail to define an elongated hose receiving guide space, the space between the adjacent hose support pegs larger than the diameter of the fire hoses so the fire hoses can be bent and draped over the hose support pegs, said hose support pegs the same length, the guide space between the free ends of the hose support pegs and the adjacent connecting guide bars or protective rail large enough so when a fire hose is bent the bent portion can be inserted in said space in a plane transverse to the direction of projection of the hose support pegs and draped over one or more hose support pegs depending on the effective radius of curvature of the bent portion of the fire hose but small enough so the adjacent protective or connecting guide bars or rails serve to engage and guide any hose falling off the hose support pegs so they fall to the ground directly below the platform rack.

2. The apparatus for drying fire hoses described in claim 1 wherein said hose support pegs project in an upwardly inclined direction with respect to the plane defined by the protective rail.

3. The apparatus described in claim 1 wherein said vertical support comprises an I-beam, an electrically powered hoist mounted adjacent the top of said I-beam and connected to said platform rack, upper and lower truck members rollably mounted on said I-beam, said upper truck member secured to an adjacent protective side rail on said platform rack, the lower truck member connected to one end of a support brace, the opposite end of said support brace connected to the said protective rail remote from the I-beam, and said control means for the electrically powered hoist mounted near the lower portion of the I-beam.

4. The apparatus for drying fire hoses described in claim 2 wherein said vertical support comprises an I-beam, an electrically powered hoist, at least part of the hoist mounted adjacent the top of said I-beam and connected to said platform rack, upper and lower truck members rollably mounted on said I-beam, the upper truck member secured to the adjacent protective side rail, the lower truck member secured to a brace strut, said brace strut connected between the lower truck member and the protective side rail remote from said I-beam, said control means for electrically powering the hoist mounted near the lower portion of said I-beam.

5. An apparatus for drying fire hoses comprising a vertical support, a hoist, at least a part of the hoist mounted at least near the upper ends of the vertical support, a platform rack moveably mounted on said vertical support, means connecting at least a portion of said hoist with the platform rack, hoist control means connected to at least a portion of the hoist for raising and lowering the platform rack, said platform rack comprising a support portion to which at least a part of the hoist is connected, side and end protective guide rails surrounding said support portion and in fixed relationship thereto, hose support pegs surrounded by said side and end protective guide rails secured at one end to a portion of a protective rail and in spaced parallel relationship to each other with the free ends of the hose support pegs projecting toward but not reaching another portion of an adjacent protective rail or bar and defining a hose receiving guide space, the space between said parallel hose support pegs larger than the diameter of the fire hoses so the fire hoses can be draped over each hose support peg, the space between the free ends of the hose support pegs and the said another portion of a protective rail large enough so a fire hose can be bent and the bent portion inserted in said space to permit the fire hose to be draped over one or more support pegs depending on the effective radius of curvature of the fire hose at the bend but small enough so the adjacent connecting guide bars or rails serve to engage and guide any hose falling off the hose support pegs so they fall to the ground in the region directly below the platform rack.

6. An apparatus for drying fire hoses comprising a vertical support, a hoist, at least a portion of the hoist mounted at least near the upper end of the vertical support, a platform rack moveably mounted on said vertical support, means connecting at least a portion of the hoist with the platform rack, hoist control means connected to at least a portion of the hoist for raising and lowering the platform rack, said platform rack comprising a support portion to which the hoist is connected, a rectangular framework of protective guide rails surrounding said support portions comprising side and end protective rails, hose support pegs surrounded by said side and end protective rails connected at one end to at least one protective rail with their free ends projecting toward but not reaching a parallel protective guide rail or bar and defining an elongated hose receiving guide space, said hose support pegs mounted so their free ends project in an upwardly inclined direction from the plane defined by the protective rails, the space between the adjacent hose support pegs larger than the diameter of the fire hoses so fire hoses can be draped over the hose support pegs, the guide space between the free ends of the hose support pegs and the said parallel protective rail large enough so when a fire hose is bent the bent portion can enter said space whereby the bent portion of the fire hose can be draped over one or more of the hose support pegs depending on the effective radius of curvature of the bent portion of the fire hose and small enough so the adjacent guide bars or rails serve to engage and guide any hose falling off the hose support pegs so they fall to the ground in the region directly below the platform rack.

7. An apparatus for drying fire hoses comprising a vertical support, a hoist, at least a portion of the hoist mounted at least near the upper end of the vertical support, a platform rack moveably mounted on said vertical support, means connecting at least a part of the hoist with the platform rack, hoist control means connected to at least a portion of the hoist for raising and lowering the platform rack, said platform rack comprising a support portion to which at least a portion of the hoist is connected, a rectangular framework of protective guide rails surrounding said support portion and comprising parallel side and parallel end protective rails, connecting bars parallel to at least one protective guide rail and in fixed relationship to said platform, hose support pegs surrounded by said protective guide rails in spaced parallel relationship to each other and connected at only one end to a protective rail or to the said connecting bars, and projecting toward but not reaching a protective guide bar or rail and defining an elongated hose receiving guide space, said hose support peg mounted so they project in an upwardly inclined direction from the plane defined by said protective rails, the lateral space between adjacent hose support pegs larger than the diameter of the fire hoses so the fire hoses can be bent and draped over the hose support pegs, said hose support pegs the same length, the guide space between the free ends of the hose support pegs and an adjacent connecting bar or protective rail large enough so when a fire hose is bent, the bent portion can be inserted in said free space transverse to said hose support peg and moved and draped over one or more hose support pegs depending on the effective radius of curvature of the bent portion of the fire hose but small enough so the adjacent protective or connecting guide bars or rails serve to engage and guide any hose falling off the hose support pegs so they fall to the ground in the region directly below the platform rack.

* * * * *